United States Patent [19]

Martin

[11] Patent Number: 4,478,442

[45] Date of Patent: Oct. 23, 1984

[54] SAFETY LOCK ON ENTRANCE DOOR

[76] Inventor: Edward J. Martin, 5921 Oliver Ave. South, Minneapolis, Minn. 55419

[21] Appl. No.: 429,246

[22] Filed: Sep. 30, 1982

Related U.S. Application Data

[63] Continuation-in-part of Ser. No. 286,566, Jul. 24, 1981, abandoned.

[51] Int. Cl.[3] ..... E05C 17/36

[52] U.S. Cl. ..... 292/248

[58] Field of Search ..... 292/246, 248, 262, 264

[56] References Cited

U.S. PATENT DOCUMENTS

| | | | |
|---|---|---|---|
| 878,607 | 2/1908 | Cairns . | |
| 1,285,112 | 11/1918 | Gainer | 292/248 |
| 2,726,112 | 12/1955 | Conhagen | 292/264 |
| 2,770,482 | 11/1956 | Kusiek | 292/246 |
| 3,451,708 | 6/1969 | Brooks | 292/264 |
| 3,640,558 | 2/1972 | Gewertz et al. | 292/264 |
| 3,804,454 | 4/1974 | Simmons | 292/264 |
| 4,127,292 | 11/1978 | Mader | 292/246 |
| 4,269,439 | 5/1981 | Warwick et al. | 292/246 |

*Primary Examiner*—Richard E. Moore
*Attorney, Agent, or Firm*—Kinney & Lange

[57] ABSTRACT

In one form, a safety lock for a knob operated door includes an anchor block fastened to the framing stud of door frame. A flexible steel cable loop having a pair of parallel end portions permanently mounted in the anchor block has a cylindrical shank tightly encompassing its parallel end portions, the shank being situated in adjacent relationship to the anchor block. A cylindrical sleeve encompasses the shank and is in rotatable and longitudinally slidable relationship with respect to it. The anchor block is so situated that, when the sleeve is in encompassing, overlying relationship to the shank, the cable loop will just barely fit over the maximum diameter of the knob. With the loop aligned with the reduced portion of the knob, the sleeve is slid toward the knob to reduce the size of the loop so it cannot come back over the knob. The sleeve and the shank are so positioned as to be in alignment with the vertical slot between the door and the door frame when the safety lock is operative. In another form, the anchor block and cylindrical shank are constituted as one integral piece.

12 Claims, 7 Drawing Figures

FIG. 1
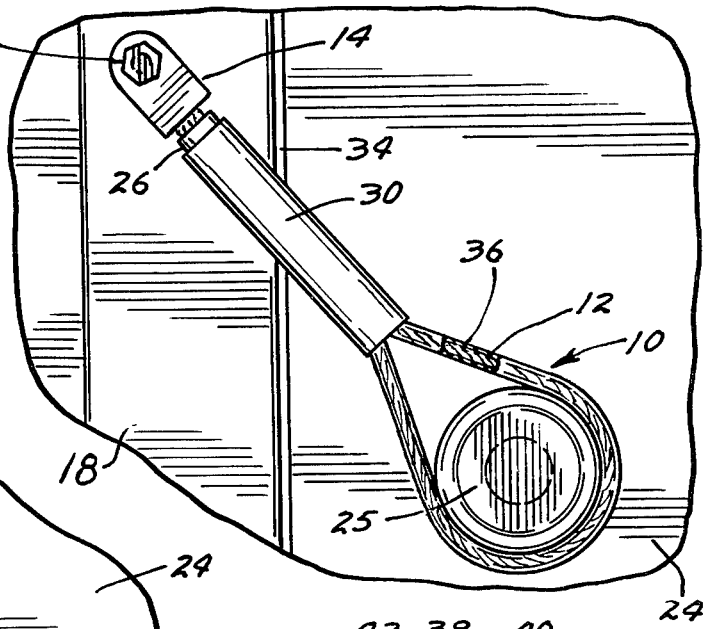
FIG. 2
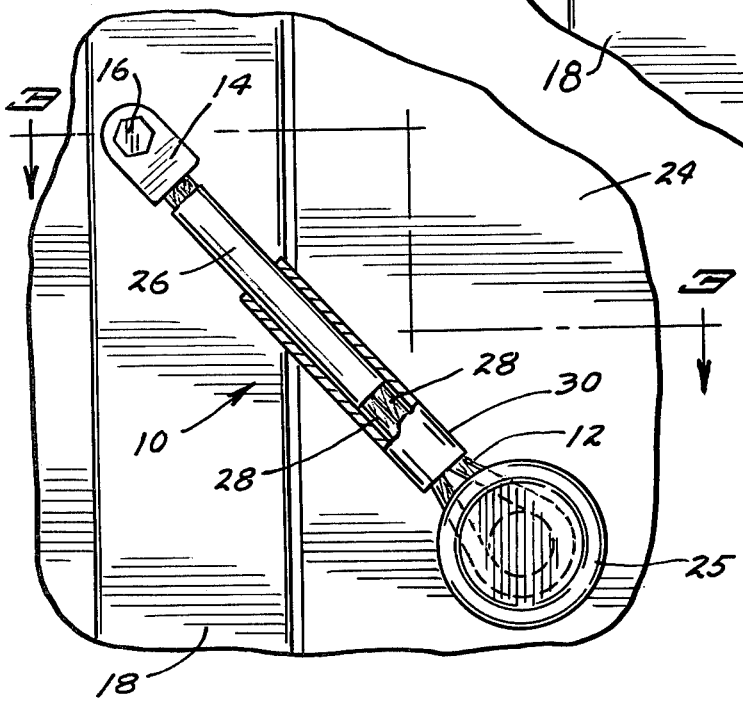
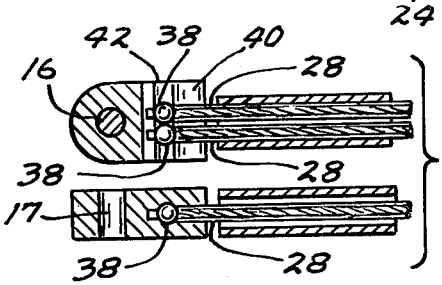
FIG. 4
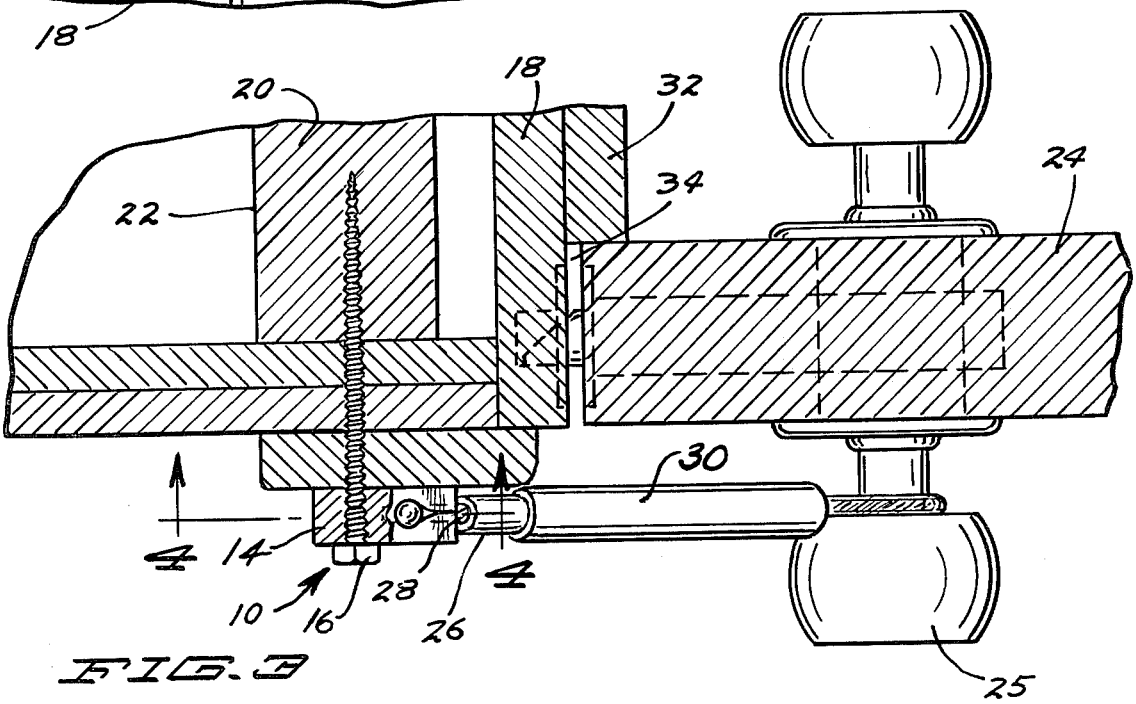
FIG. 3

SAFETY LOCK ON ENTRANCE DOOR

This is a continuation-in-part of my co-pending application Ser. No. 06/286,566, filed July 24, 1981; now abandoned.

BACKGROUND OF THE INVENTION

1. Field of the Invention

This invention has relation to safety locks for knob-operated doors wherein a loop attached to a door frame is positioned over a doorknob to prevent the door from being fully opened.

2. Description of the Prior Art

It is well known to fasten loops or rings of cable or chain or the like to door frames in position so that they can be slid over doorknobs to prevent doors from being opened more than part way.

U.S. Pat. No. 878,607 granted to Cairns in February of 1908 shows a chain with a loop in it fastened to the door frame with the loop slipped over a doorknob.

U.S. Pat. No. 2,726,112 granted to Conhagen in December of 1955 shows a double loop of chain which can be hung over the doorknob to hold the door in a partly closed condition.

U.S. Pat. No. 3,451,708 granted to Brooks in June of 1969 shows a continuous ring on the end of a chain mounted so that the ring can be slid over the doorknob to hold the door from opening.

U.S. Pat. No. 3,640,558 granted to Gewertz et al in February of 1972 shows the concept of chain loops hung over doorknobs similar to the showing of the patent to Conhagen.

U.S. Pat. No. 3,804,454 granted to Simmons in April of 1974 shows a safety doorguard made up of first and second loops of cables separated by a collar which firmly holds the cable loops. The second cable loop is fastened to a door frame by a fastener which encircles the second loop and is slidable with respect to it. The first loop is in position to slide over the doorknob of a door adjacent the door frame. As seen in FIG. 6 of that patent, the loop is designed to fit loose enough so that the door can be opened far enough for the occupant inside to see the identity of the person at the door. This leaves the cable loops and the collar vulnerable to cutting action by a person outside the door if the door is opened surreptitiously by such person with forced entry as an object.

The above patents were the closest found on a search of the present invention. The inventor and those in privity with him are aware of no prior art closer than that set out above and are aware of no prior art which anticipates the claims herein.

SUMMARY OF THE INVENTION

In a first form of the invention, a safety lock for a knob-operated door includes an anchor block firmly mounted into the framing stud of a door frame, a metallic cable loop including two parallel end portions permanently bonded in the anchor block; a security shank closely encompassing the parallel end portions of the loop, located in adjacent relationship to the anchor block; a security sleeve in longitudinally slidable telescopic, easily rotatable adjacent relationship with respect to the security shank and in encompassing relationship to the cable loop. The anchor block is fastened to the framing stud of the door frame in position so that the loop will fit over the end of the doorknob when the security sleeve is slid back along the security shank toward the anchor block; and so that when the security sleeve is slid in direction toward the doorknob to encompass additional portions of the loop, the size of the loop is reduced whereby it will no longer pass over the doorknob.

In a second form of the invention, the anchor block and the cylindrical shank are one integral security tube having an anchor block portion and a shank portion. A security sleeve is situated in longitudinally slidable telescopic, easily rotatable relationship with respect to the shank portion of the security tube and in encompassing relationship to the cable loop. The anchor block portion of the security tube is fastened to the framing stud of the door frame in position so that the loop will fit over the end of the door knob when the security sleeve is slid back along the security tube toward the anchor block portion, and so that when the security sleeve is slid in direction toward the door knob to encompass additional portions of the loop, the size of the loop is reduced whereby it will no longer pass over the door knob.

In the forms of the invention as shown, the elongated metallic cable loop is covered with a plastic coating throughout its length.

BRIEF DESCRIPTION OF THE DRAWINGS

FIG. 1 is an elevational view of the safety lock of a first form of the invention positioned as when being installed over a doorknob of a door to be locked;

FIG. 2 is an elevational view similar to the view in FIG. 1 but showing a security sleeve slid down on a cable loop in position to prevent the loop from being taken off of the doorknob;

FIG. 3 is an enlarged horizontal sectional view taken on the line 3—3 in FIG. 2;

FIG. 4 is a composite sectional view taken on the line 4—4 in FIG. 3 and taken at right angles to that line showing an anchor block end portion of the safety lock of the invention and illustrating particularly one method of bonding the parallel portions of the flexible cable loop to the anchor block;

DETAILED DESCRIPTION OF THE PREFERRED EMBODIMENTS

Figure 5:
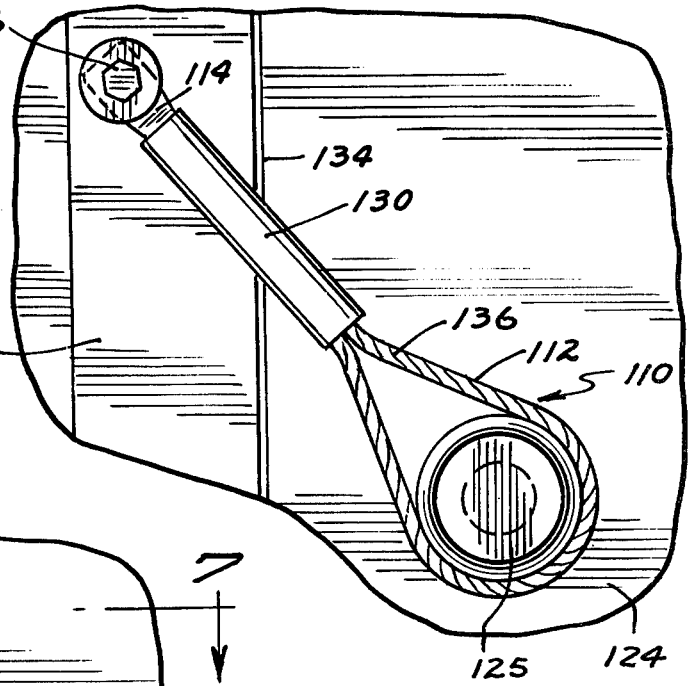
FIG. 5 is an elevational view of a safety lock of a second form of the invention positioned as when being installed over a door knob of a door to be locked.

Referring now to FIGS. 1 through 4, in a first form of the invention, a safety lock 10 includes a cable loop 12 permanently bonded or swaged into an anchor block 14. The anchor block is pivotally attached by a lag screw 16 through an opening 17 in the block and through door framing 18 into a framing stud 20 which forms a permanent part of the framework 22 of the room or building which is to be locked.

A door 24 is hingedly supported on an opposite side (not shown) of the door framing 18 in any usual or preferred manner. A doorknob 25 is mounted in the door 24.

A hardened and tempered steel cylindrical security shank 26 is positioned in tight surrounding relationship to parallel end portions 28,28 of the cable loop 12 to have one end thereof lying in adjacent relationship to the anchor block 14. A hardened and tempered steel cylindrical security sleeve 30 is mounted in surrounding relationship to the shank 26 to be slidable longitudinally thereof and easily rotatable relative thereto.

In the forms of the invention as shown, the cable loop 12 can be made of any woven, twisted or otherwise constructed flexible material which can withstand the forces applied. Cable commonly referred to as airplane cable and cable commonly utilized for making flexible bicycle lock-up bands or lines will be excellent for the purpose.

To install the safety lock 10, the parts are positioned as seen in FIG. 1, but without the lag screw in place. With the cable loop 12 positioned around the largest circumference of the doorknob 25, and with the sleeve 30 positioned to be in encompassing, overlying relationship to all of shank 26, the anchor block 14 will be positioned so that the center of its lag screw opening 17 will be in alignment with the framing stud 20. The lag screw 16 will then be installed, and installation has been completed.

When not in use, the safety lock of the invention will lie in vertical relationship (not shown) with respect to, and below, the lag screw 16.

In order to use safety lock 10, it will be installed on the doorknob 25 by positioning the parts as seen in FIG. 1. Once the loop 12 is in surrounding relation to the narrow shank of the doorknob, security sleeve 30 will be slid toward the doorknob to lengthen that portion of the loop 12 which consists of parallel end portions 28,28 thus greatly reducing the loop portion to the point where that loop cannot possibly pass over the largest circumference of the doorknob 25.

As best seen in FIG. 3, the relationship of the parts is then such that should a person attempting to force entry destroy or remove a door stop 32 of the door framing 18, and access the safety lock with a cutting instrument such as a hacksaw blade through an opening 34 between the door 24 and the door framing, the hacksaw blade will come in contact with the outside of the sleeve 30, and if the blade can affect the sleeve 30 sufficiently with its teeth to dig into it, the sleeve will simply rotate or spin around the shank 26, thus inhibiting or neutralizing any sawing effect of the hacksaw blade.

Should forcable entry be attempted by forcing something in the nature of bolt cutter blades through the opening 34 between the door and the door frame, such blades would necessarily have to be quite narrow, and would have to cut through the hardened sleeve 30, the hardened shank 26, and also the parallel end portions 28,28 of the cable loop 12 before entry through the door 24 could be obtained.

To unlock the safety lock 10, the door 24 has to be in completely closed to the position as seen in FIG. 3. The sleeve 30 is slid back over the shank 26 to position adjacent the anchor block 14, and the cable loop 12 slid back over the largest circumference of the doorknob 25, as seen in FIG. 1. The safety lock will then take vertical position below the lag screw 16, and will be out of the way until it is needed again.

In the forms of the invention as shown, a plastic layer or sleeve 36 is bonded to or slid over the cable loop 12 throughout its entire length.

A method of manufacture of the safety lock 10 includes sliding or forcing the two parallel end portions 28,28 through the interior of the cylindrical shank 26, sliding the sleeve 30 onto and over top of the shank 26, swaging one of two cylindrical anchor slugs 38,38 onto each of the ends of the end portions 28,28, inserting both of the end portions 28,28 of the loop 12 into a provided slot 40 in anchor block 14 while simultaneously sliding each of the slugs 38,38 into a provided cylindrical groove 42 in that anchor block, and then providing force on the anchor block to close the slot 40 down on and around the parallel end portions 28,28. The positioning of the parts after the end portions 28 and the anchor slugs 38 have been installed is seen in the composite view of FIG. 4. The positioning of the parts after the force has been applied to deform the anchor block around the end portions 28,28 is illustrated in FIG. 3.

Figure 6:
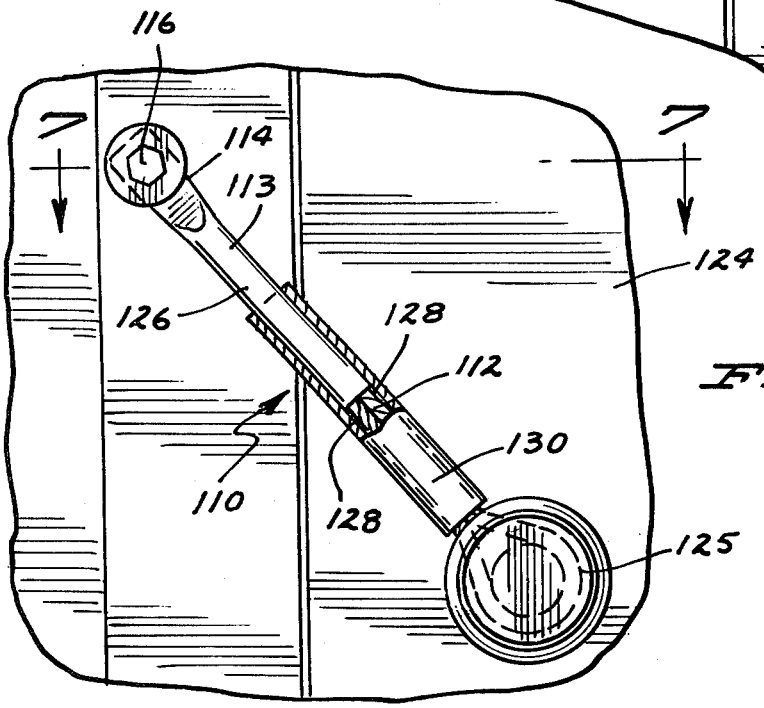
FIG. 6 is an elevational view similar to the view of FIG. 5 but showing a security sleeve slid down on the cable loop in position to prevent the loop from being taken off of the door knob.
Figure 7:
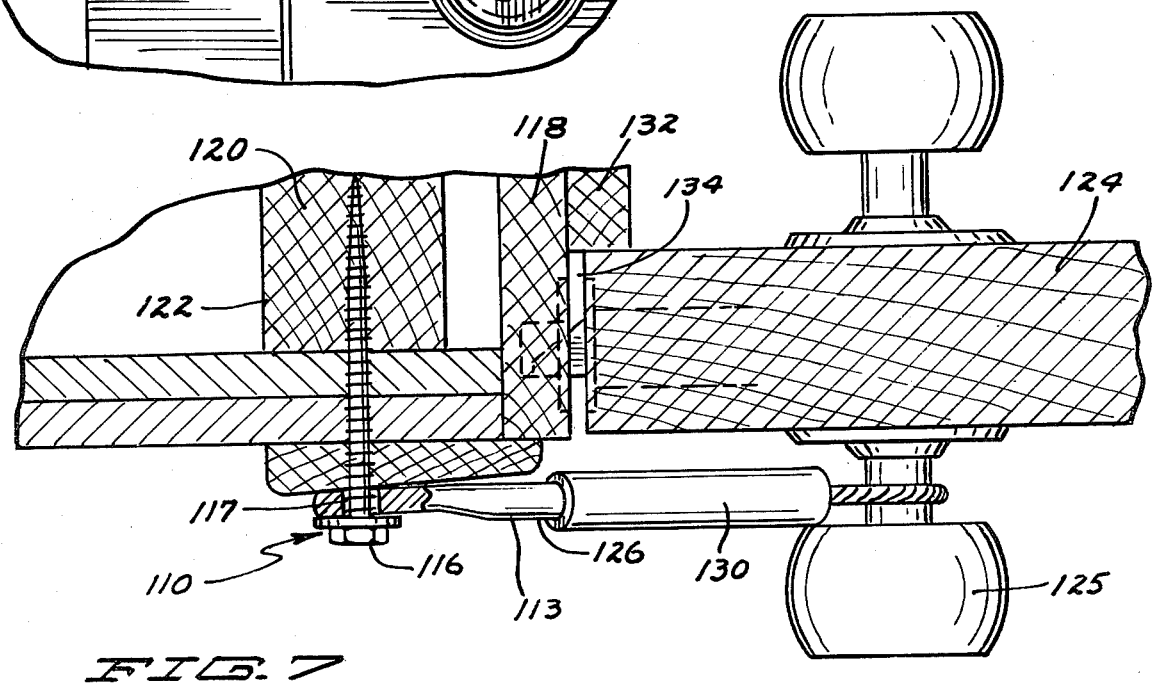
FIG. 7 is an enlarged horizontal sectional view taken on the line 7—7 in FIG. 6.

Referring now to FIGS. 5 through 7, in accordance with a second form of the invention, safety lock 110 includes a cable loop 112 permanently bonded or swaged into a hardened and tempered steel, nominally cylindrical, security tube 113. The security tube is made up of an anchor block portion 114 and an integral security shank portion 126. The anchor block portion 114 is pivotally attached by a lag screw 116 through an opening 117 in the anchor block portion and through door frame 118 into a framing stud 120 which forms a permanent part of framework 122 of the room or building which is to be locked. Door 124 is hingedly supported on an opposite side (not shown) of the door framing 118 in any usual or preferred manner. A door knob 125 is mounted in the door 124.

The security shank portion 126 of the security tube 113 is positioned in tight surrounding relationship to parallel end portions 128,128 of the cable loop 112, and that loop extends outwardly thereof at an end opposite the anchor block portion 114. A hardened and tempered steel cylindrical security sleeve 130 is mounted in surrounding relationship to the shank portion 126 to be slidable longitudinally thereof and easily rotatable relative thereto.

To install the safety lock 110, the parts are positioned as seen in FIG. 1 but without the lag screw in place. The cable loop 112 is positioned around the large circumference of the door knob 125, and with the sleeve 130 positioned to be in encompassing, overlying relationship to all of the shank portion 126. The anchor block portion 114 of the security tube 113 will be positioned so that the center of its lag screw opening 117 will be in alignment with the framing stud 120. The lag screw 116 will then be installed, and the installation has been completed. When not in use, the safety lock of the invention will lie in vertical relationship (not shown) with respect to, and below the lag screw 116.

In order to use safety lock 110, it will be installed on the door knob 125 by positioning the parts as seen in FIG. 5. Once the loop 112 is in surrounding relation to the narrow shank of the door knob, security sleeve 130 will be slid toward the door knob to lengthen that portion of the loop 112 which consists of parallel end portions 128,128, thus greatly reducing the loop portion to the point where that loop cannot possibly pass over the largest circumference of the door knob 125.

As best seen in FIG. 7, the relationship of the parts is then such that should a person attempting to force entry destroy or remove a door stop 132 of the door framing 118, and access the safety lock with a cutting instrument such as a hacksaw blade through an opening 134 between the door 124 and the door framing, the hacksaw blade will come in contact with the outside of the sleeve 130, and if the blade can affect the sleeve 130 sufficiently with its teeth to dig into it, the sleeve will simply rotate or spin around the security tube 113, thus inhibiting or neutralizing any sawing effect of the hacksaw blade.

Should forceable entry be attempted by forcing something in the nature of bolt cutter blades through the opening 134 between the door and the door frame, such blades would necessarily have to be quite narrow, and would have to cut through the hardened sleeve 130, the hardened security tube 113 and also the parallel end portions 128,128 of the cable loop 112 before entry through the door 124 could be obtained.

To unlock the safety lock 110, the door 124 has to be completely closed to the position as seen in FIG. 7. The sleeve 130 is slid back over the tube 113 to position adjacent the anchor block portion 114, and the cable loop 112 slid back over the largest circumference of the door knob 125, as seen in FIG. 1. The safety lock will then take vertical position below the lag screw 116, and will be out of the way until it is needed again.

In the form of the invention as shown, a plastic layer or sleeve 136 is bonded to or slid over the cable loop 12 throughout its entire length.

A method of manufacture of the safety lock 110 includes the sliding or forcing of the two parallel end portions 128,128 through the security sleeve 130, and then extending these end portions through the security tube 113 in direction from the security shank portion 126 toward and through the anchor block portion 114. With the ends of the end portions 128,128 substantially exactly in alignment with the outer end of the anchor block portion 114, the anchor block portion will be subjected to a swaging hammer blow to permanently affix the end portions 128,128 in the anchor block portion.

It is at this point that opening 117 will be drilled through the anchor block portion.

Although the present invention has been described with reference to preferred embodiments, workers skilled in the art will recognize that changes may be made in form and detail without departing from the spirit and scope of the invention.

What is claimed is:

1. A safety lock for a knob operated door mounted in a door frame including a framing stud, said safety lock including:

an anchor block having a lag screw receiving opening therethrough;

a flexible cable loop having a pair of parallel end portions permanently mounted in the anchor block;

a cylindrical shank tightly encompassing the loopend portions in adjacent relation to the anchor block;

a cylindrical sleeve in encompassing, rotating and longitudinal sliding relation to said shank; and a lag screw extending through said provided opening in said anchor block and into said framing stud in position to permit said cable loop to fit over a knob on said door when said sleeve is positioned adjacent said anchor block and to prevent said loop from being removed from said doorknob when said sleeve is moved close to the limit of its movement toward said knob.

2. The safety lock of claim 1 wherein:

said shank is so positioned when said lock is operative as to pass through an imaginary vertical plane normal to the door and encompassing the space between the vertical adjacent edges of the door and door frame.

3. The safety lock of claim 2 wherein:

said sleeve is so positioned when said lock is operative as to pass through said imaginary plane.

4. The safety lock of claim 1 wherein:

said cable loop is encompassed by a plastic sheath.

5. A safety lock for a knob operated door mounted in a door frame, said safety lock including:

an anchor block having a fastening means receiving opening therethrough;

a flexible elongated cable-like loop having a pair of parallel end portions permanently mounted in the anchor block;

a cylindrical sleeve in encompassing relation to the loop end portions and longitudinally slidable relative to the loop; and fastening means extending through said provided opening in said anchor block and into said door frame in position to permit said cable loop to fit over a knob on said door when said sleeve is positioned adjacent said anchor block and to prevent said loop from being removed from said doorknob when said sleeve is moved close to the limit of its movement toward said knob.

6. The safety lock of claim 5 wherein:

said sleeve is so positioned when said lock is operative as to pass through an imaginary plane normal to said door and encompassing the space between the vertical adjacent edges of said door and said frame.

7. The safety lock of claim 5 wherein:

said cable loop is encompassed by a plastic sheath.

8. The safety lock of claim 1 wherein:

said anchor block and said cylindrical shank are integral with each other.

9. The safety lock of claim 8 wherein:

said anchor block and shank together form a security tube having an anchor block portion and a shank portion; and said cable loop ends are permanently anchored in the anchor block portion and extend through the shank portion.

10. The safety lock of claim 9 wherein:

said security tube is so positioned when said lock is operative as to pass through an imaginary vertical plane normal to the door and encompassing the space between the vertical adjacent edges of the door and door frame.

11. The safety lock of claim 10 wherein:

said sleeve is so positioned when said lock is operative as to pass through said imaginary plane.

12. The safety lock of claim 8 wherein:

said cable loop is encompassed by a plastic sheath.

* * * * *